US006682443B1

(12) United States Patent
Liu

(10) Patent No.: US 6,682,443 B1
(45) Date of Patent: Jan. 27, 2004

(54) WRITABLE GOLF TEE WITH AN ADJUSTABLE LENGTH

(76) Inventor: Chien-Cheng Liu, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/205,358

(22) Filed: Jul. 26, 2002

(51) Int. Cl.[7] ..... A63B 57/00
(52) U.S. Cl. ..... 473/387; 473/396
(58) Field of Search ..... 473/387–403

(56) References Cited

U.S. PATENT DOCUMENTS 1,730,046 A * 10/1929 Stow ..... 473/391
3,273,890 A * 9/1966 Williams ..... 401/52
4,610,451 A * 9/1986 Keys ..... 473/396
5,720,677 A * 2/1998 Rudduck ..... 473/387

FOREIGN PATENT DOCUMENTS

GB 2227416 A * 8/1990 ..... A63B/57/00

* cited by examiner

*Primary Examiner*—Steven Wong
(74) *Attorney, Agent, or Firm*—Troxell Law Office PLLC

(57) ABSTRACT

A writable golf tee with an adjustable length is assembled by screwing first, second and third members; wherein the end portion of the second member is disposed with a pencil lead for writing; the second and the first member screw to form a short golf tee which further screws the third member at the upper aspect to form a long golf tee for more convenient application.

1 Claim, 5 Drawing Sheets

WRITABLE GOLF TEE WITH AN ADJUSTABLE LENGTH

BACKGROUND OF THE INVENTION

1. Field of the Invention

The present invention relates to a writable golf tee with an adjustable length, more particularly to an assembled golf tee with three segments thereby replacing the conventional use of having several long and short golf tees as well as a pencil to lower the cost, facilitate the carrying and the application.

2. Description of the Prior Art

Accordingly, a golf player uses a golf tee to hold a golf ball for driving and then chooses a proper golf club according to the situation for making a best swing. For example, the player uses a long golf tee and usually a wood golf club to drive long; otherwise, a short golf tee and an iron golf club is used. Therefore, for achieving the very initial advantage at the beginning of golf playing and for having full equipment, most of the players have to carry various small gears including long and shot golf tees as well as a 2B pencil for recoding the scores. Although only one golf tee is needed for each swing but several ones are carried to be selected for different situations. In addition, more than one pencil is carried in case of having a broken lead. Thus a small preparation causes the carrying troublesome and requires more gear purchasing. That is the shortcoming of a conventional application.

SUMMARY OF THE INVENTION

Therefore, the primary objective of the present invention is to design a golf tee to be easily assembled into a long or a short length for driving a golf ball. Furthermore, the interior portion is disposed with a pencil lead for direct writing function thereby simplifying the number of the parts needed in application, facilitating the carrying and saving a tremendous part cost.

In order to achieve the abovementioned objectives, the present invention comprises a first member, a second member and a third member upwardly; wherein the lower end of the first member is disposed as a cone and the upper end thereof concaves inwardly to form a threaded hollow slot; the upper end of the second member gradually extends into a flare-shaped convex portion with a dual diameter hole concavely disposed on the end plane thereof; the inner rim of the narrower hole diameter at the center of the dual diameter hole is disposed with threads. The lower end of the second member is convexly disposed with a bolt inserted by a pencil lead to be screwed into the hollow slot of the first member to form a short golf tee. The two ends of the third member convex in flare-shapes; the middle section thereof forms as a structure with a narrower diameter; a hole slot is concavely disposed at the upper end and a bolt is disposed at the lower end; the bolt screws at a thread end of the dual diameter hole of the second member to form a long golf tee. Therefore, a golf tee with three segments replaces the conventional application of using several long and short golf tees as well as a pencil thereby reducing the cost and facilitating the carrying.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
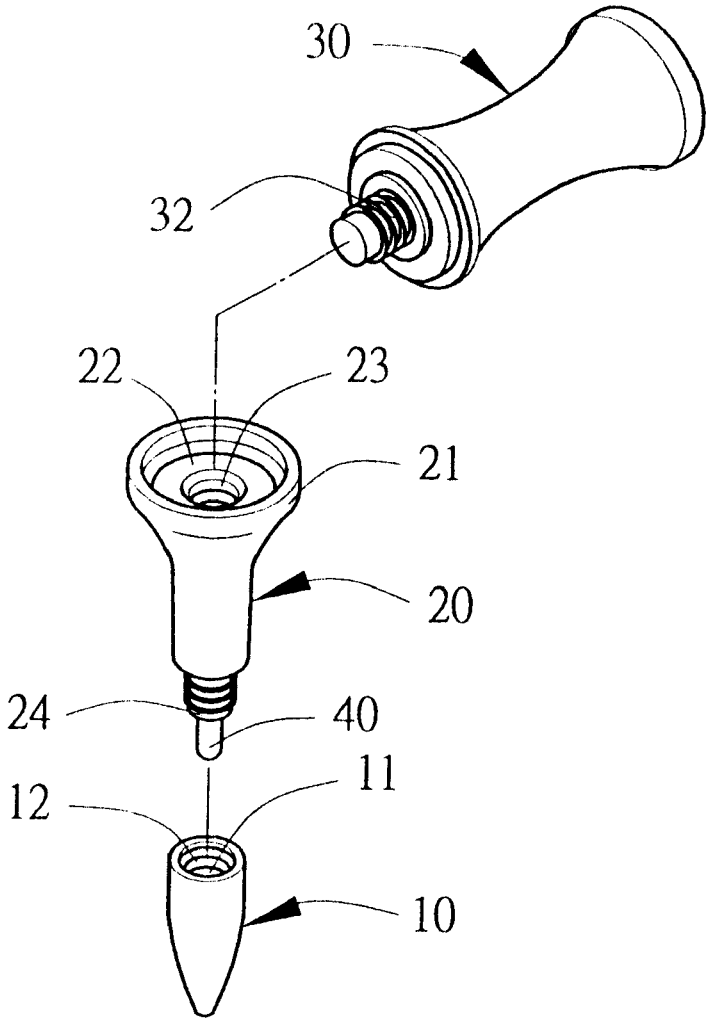
FIG. 1 is an exploded drawing of the structure of the present invention.
Figure 2:
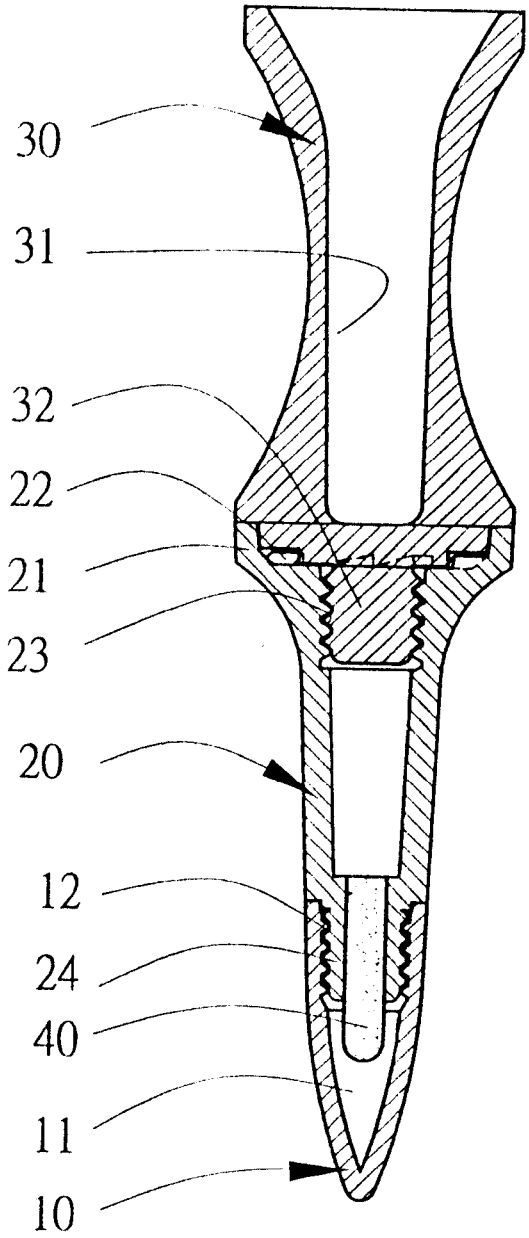
FIG. 2 is a drawing of the assembled present invention.

Referring to FIGS. 1 and 2, the golf tee of the present invention is designed to have three segments comprising a first member (10), a second member (20) and a third member (30); wherein the lower end of the first member (10) is disposed as a cone and the upper end thereof concaves inwardly to have a recess or aperture (11) with threads (12) at the opening end thereof.

Figure 4:
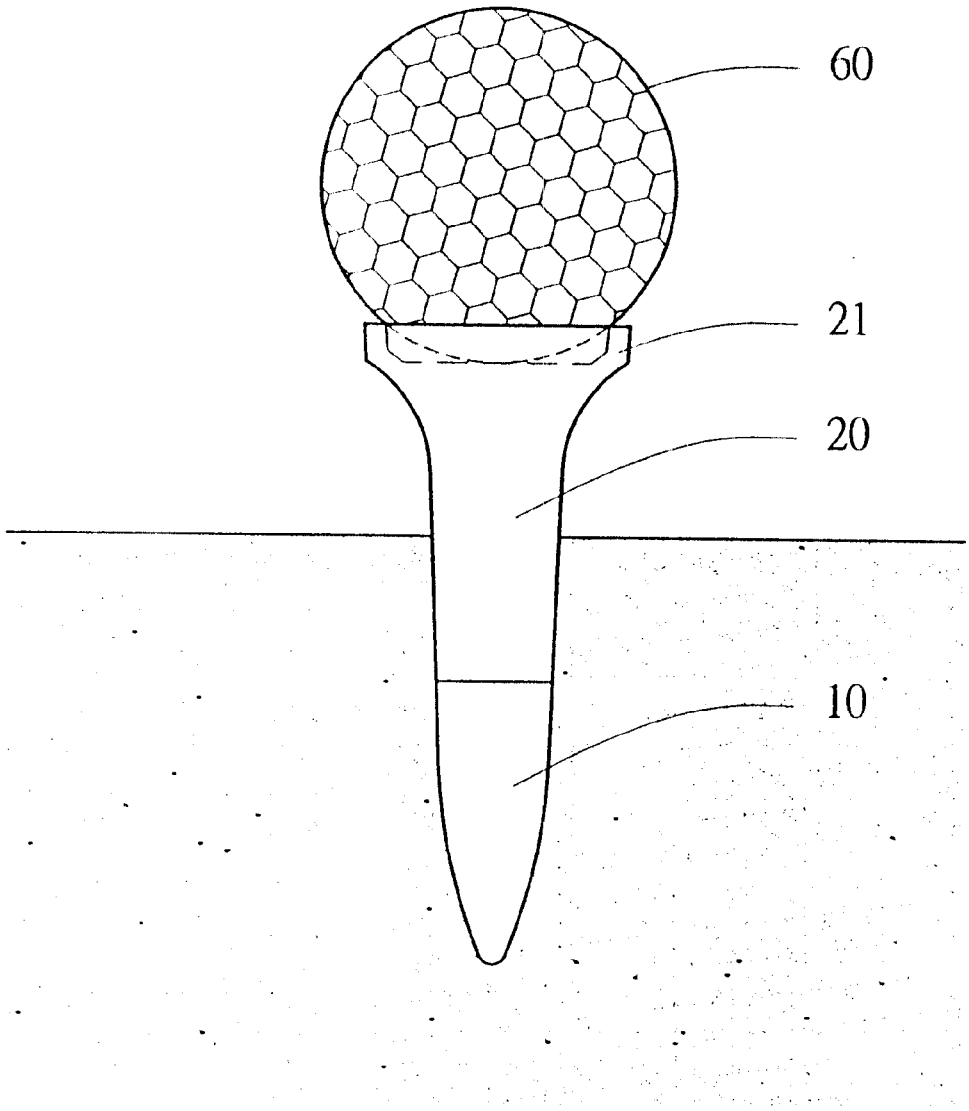
FIG. 4 is a drawing of the second exemplary embodiment of the present invention.

The upper end of the second member (20) gradually forms a flare-shaped concave portion (21) with a dual diameter hole (22) concavely disposed on the end plane of the convex portion (21). Threads (23) are disposed on the inner rim of the narrower hole diameter at the center of the dual diameter hole (22). A bolt (24) is convexly disposed at the lower end of the second member (20) and has a pencil lead (40) inserted at the center of the end portion of the bolt (24); the bolt (24) with the pencil lead (40) screws into the recess (11) at the upper end of the first member (10); the bolt (24) tightly screws the threads (12) so as to assemble the first member (10) and the second member (20) into a short golf tee, as shown in FIG. 4; that means the dual diameter hole (22) at the upper aspect of the second member (20) holds the golf ball (60) while the lower aspects of the first member (10) and the second member (20) insert into the ground for support. For recording the scores, it is merely necessary to get the pencil lead (40) of the second member (20) for writing and that is very convenient.

Figure 3:
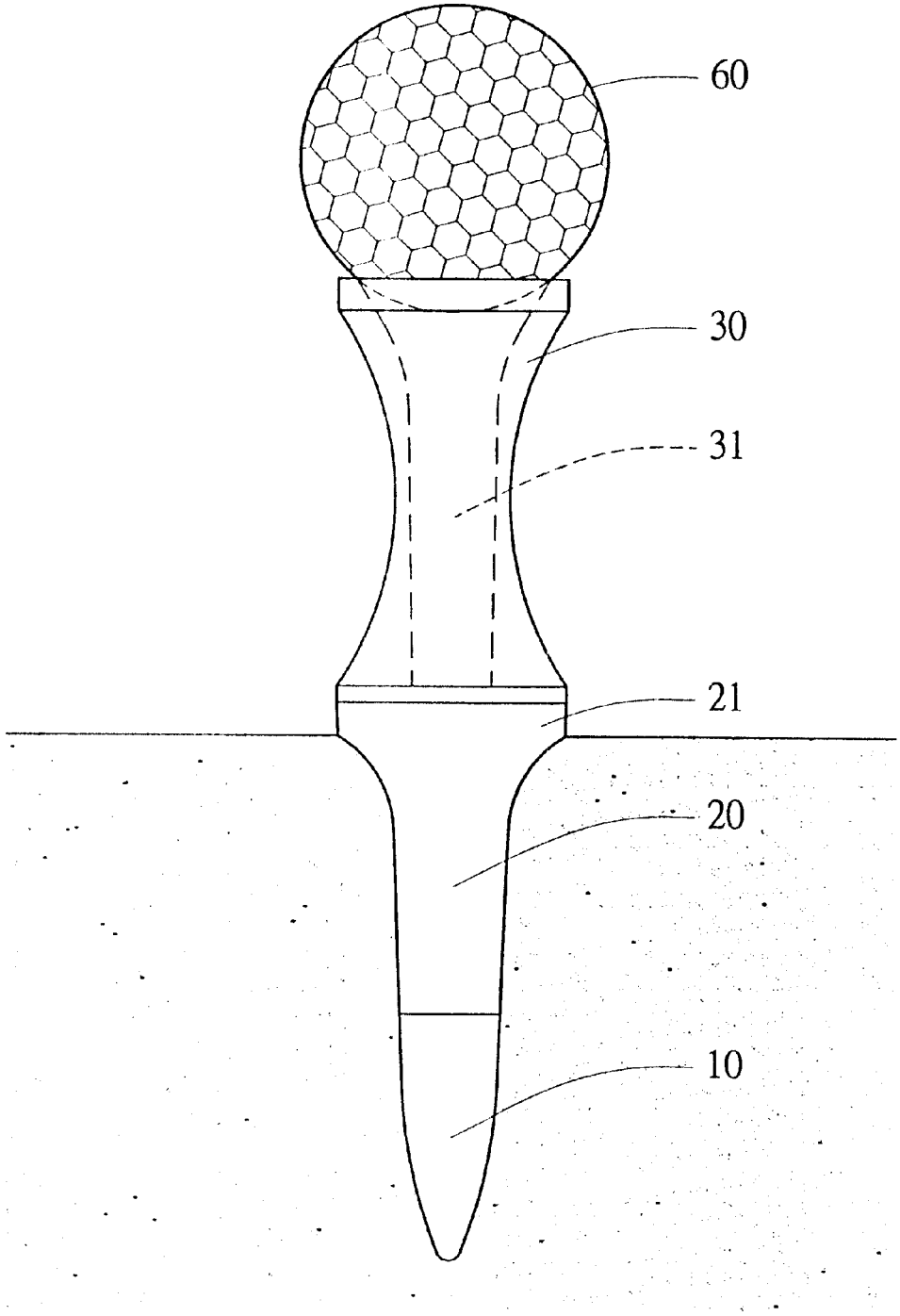
FIG. 3 is a drawing of the first exemplary embodiment of the present invention.

Referring to FIGS. 1, 2 and 3, the two ends of the third member (30) convex in flare-shapes and the middle section thereof forms a structure with a narrower diameter; in addition, the upper end portion concaves inwardly to have a hole slot (31) cooperating with the flare-shaped structure to fitly form an area for holding the golf ball (60); the end portion of the lower end is disposed with a bolt (32) to screw the thread (12) end of the dual diameter hole (22) of the second member (20); as indicated in FIG. 3, the top portion of the third member (30) holds the golf ball (60) while the lower aspects of the first member (10) and the second member (20) insert into the ground for support. Therefore the position between the third member (30) and the convex portion (21) of the second member (20) is held in another height for facilitating the golf ball (60) hitting.

Figure 5:
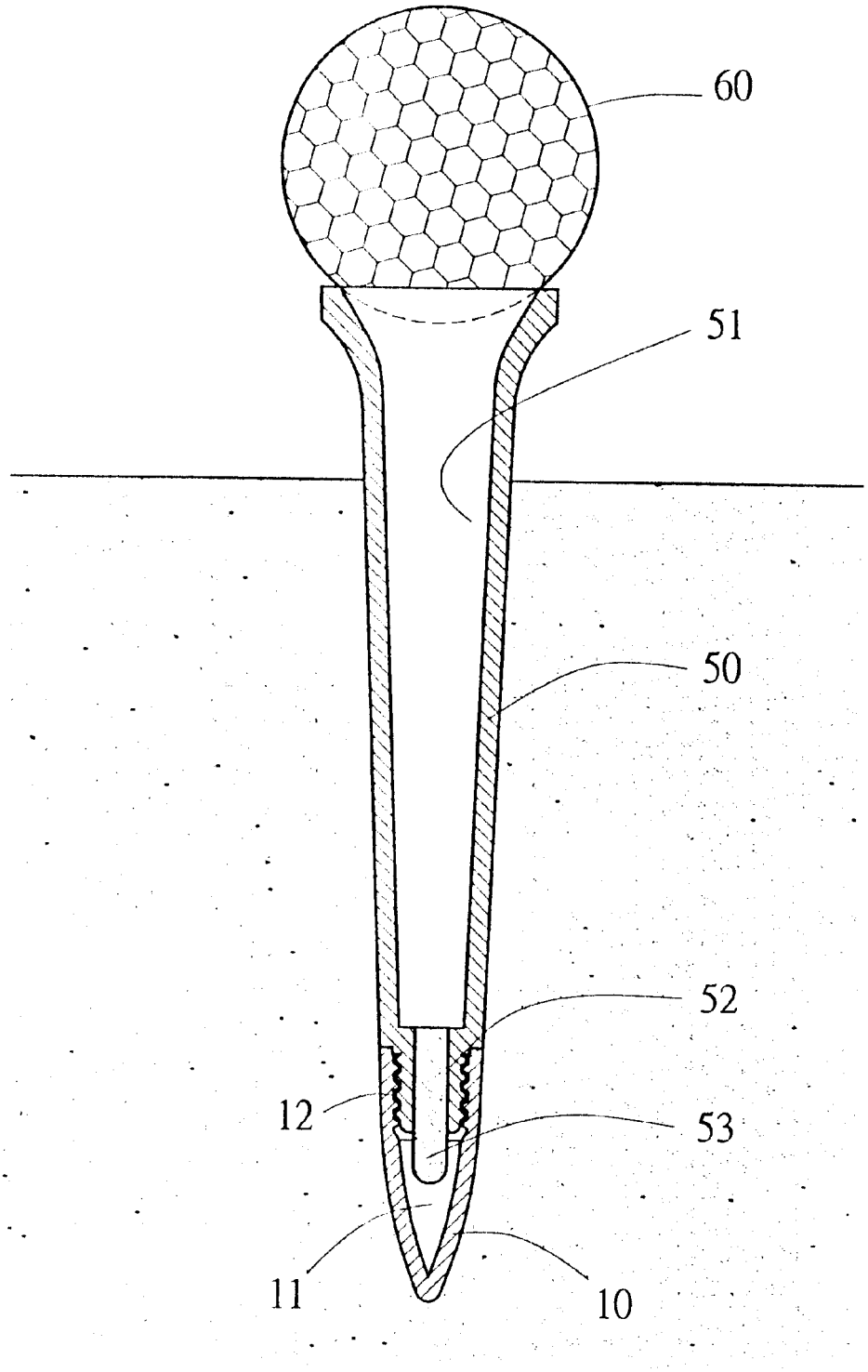
FIG. 5 is a drawing of the third exemplary embodiment of the present invention.

The present invention has another exemplary embodiment; as indicated in FIG. 5, a long rod member (50) replaces the second member (20) and the third member (30) shown in FIG. 2; the long rod member (50) has an upper end formed into a flare-shaped structure extending wider gradually; the top portion is downwardly and concavely disposed with a center hole (51) for holding the golf ball (60); the lower aspect thereof is disposed with a bolt (52) inserted by a pencil lead (53) to fitly screw the threads (12) at the end portion of the recess (11) of the first member (10) thereby forming a standard golf tee for deep embedment. That is another exemplary embodiment of the present invention.

With special designing ideas, the present invention has the following advantages in application:

1. The golf tee of the present invention is an assembly of three segments and just one such golf tee is enough for achieving the objective of selecting a long or a short golf tee: therefore, the number of golf tees to be carried and the cost are reduced. That is the primary objective of the present invention.

2. The present invention of a two-segment or three-segment design has a pencil lead inserted therein to make the golf tee itself has the function for writing the scores. That is more convenient in application and eliminates the trouble of carrying pencils.

3. The abovementioned golf tee is disposed with only one piece of pencil lead and that makes costing very economic; the pencil is disposable since the golf tee is a consuming product. That is another advantage of the present invention.

4. The present invention of a golf tee in three segments has a plurality of conventional long and short golf tees as well as a pencil for writing; the present invention reduces the cost and is easy and convenient for carrying; the multi-functional and applications make the present invention even more convenient unique.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A writable golf tee with an adjustable length comprising: a first member, a second member and a third member; wherein a lower end of the first member is disposed as a cone and an upper end thereof concaves inwardly to form a recess having threads;

an upper end of the second member gradually forms a flare shaped convex portion; a dual diameter hole is concavely disposed on an end of the convex portion; an inner rim of a narrower diameter hole at a center of the dual diameter hole is disposed with threads; a lower end of the second member is convexly disposed with a bolt and a pencil lead inserted into the end portion of the bolt wherein the bolt screws into the recess of the first member to form a short golf tee;

two ends of the third member have convex flare-shapes and a middle section thereof forms a structure with a narrower diameter; a hole slot is concavely disposed on an upper end; a lower end is disposed with a bolt to be screwed into the threaded end of the dual diameter hole of the second member to form a long golf tee.

* * * * *